US007805932B2

(12) United States Patent
Oxborrow

(10) Patent No.: US 7,805,932 B2
(45) Date of Patent: Oct. 5, 2010

(54) FLOW ASSEMBLY FOR AN EXHAUST SYSTEM

(75) Inventor: James Oxborrow, Hampton Vale Peterborough (GB)

(73) Assignee: Perkins Engines Company Limited, Peterborough (GB)

( * ) Notice: Subject to any disclaimer, the term of this patent is extended or adjusted under 35 U.S.C. 154(b) by 804 days.

(21) Appl. No.: 11/529,235

(22) Filed: Sep. 29, 2006

(65) Prior Publication Data

US 2008/0098499 A1 Apr. 24, 2008

(51) Int. Cl.
*F01N 1/00* (2006.01)

(52) U.S. Cl. ..... 60/324

(58) Field of Classification Search ..... 60/324, 60/280, 306, 317–319; 123/306
See application file for complete search history.

(56) References Cited

U.S. PATENT DOCUMENTS

| | | | | | |
|---|---|---|---|---|---|
| 3,111,190 | A | * | 11/1963 | Vaughn | 181/260 |
| 3,749,130 | A | * | 7/1973 | Howitt et al. | 138/42 |
| 3,964,875 | A | | 6/1976 | Chang et al. | |
| 4,183,896 | A | | 1/1980 | Gordon | |
| 4,373,377 | A | * | 2/1983 | Smith et al. | 73/23.31 |
| 5,150,573 | A | | 9/1992 | Maus et al. | |
| D414,191 | S | | 9/1999 | Kim | |
| 5,979,395 | A | * | 11/1999 | Mallen et al. | 123/243 |
| D469,781 | S | | 2/2003 | Kim | |
| 6,536,420 | B1 | | 3/2003 | Cheng | |
| 6,543,221 | B1 | | 4/2003 | Klaus et al. | |
| 6,634,856 | B2 | | 10/2003 | Chien et al. | |
| 6,745,562 | B2 | | 6/2004 | Berriman et al. | |
| 6,796,296 | B2 | * | 9/2004 | Kim | 123/590 |
| 6,837,213 | B1 | | 1/2005 | Burnett | |
| 6,887,294 | B2 | * | 5/2005 | Kanematsu | 55/418 |
| 6,932,049 | B2 | | 8/2005 | Kim | |
| 7,104,251 | B2 | * | 9/2006 | Kim | 123/306 |
| 2005/0210843 | A1 | * | 9/2005 | Bajza et al. | 55/385.3 |
| 2006/0070375 | A1 | | 4/2006 | Blaisdell | |

OTHER PUBLICATIONS

Fresh Air Exaust, archived Dec. 19, 2005, pp. 4-5.*

* cited by examiner

*Primary Examiner*—Thomas E Denion
*Assistant Examiner*—Audrey Klasterka
(74) *Attorney, Agent, or Firm*—Finnegan, Henderson, Farabow, Garrett & Dunner LLC

(57) ABSTRACT

A flow assembly has a hollow housing including a lumen extending from a proximal aperture to a distal aperture. The flow assembly can have a first set of blades including at least one first blade disposed within the lumen, wherein the at least one first blade extends from the housing and can be positioned between the proximal aperture and the distal aperture. The flow assembly also has a second set of blades including at least one second blade disposed within the lumen, wherein the at least one second blade extends from the housing and can be positioned between the at least one first blade and the distal aperture. Also, the flow assembly can have a central passageway substantially free of blades extending from the proximal aperture to the distal aperture.

18 Claims, 4 Drawing Sheets

FLOW ASSEMBLY FOR AN EXHAUST SYSTEM

TECHNICAL FIELD

This disclosure relates generally to a flow assembly configured to modify a gas flow, more particularly, to a flow assembly for an exhaust system.

BACKGROUND

Machines that use engines, including diesel engines, gasoline engines, gaseous fuel-driven engines, and other engines known in the art, often produce a mixture of polluting emissions. These emissions may include gaseous and solid material, such as, particulate matter, nitrogen oxides, and sulfur compounds. Heightened environmental concerns have led regulatory agencies to increase the stringency of emission standards for such engines, forcing engine manufactures to develop systems to further reduce emission levels.

One type of device used by manufacturers to reduce machine emissions is a particulate filter configured to remove particulate matter from an exhaust stream. A particulate filter includes a filter assembly located in an exhaust system and configured to trap particulate matter. While such filters can reduce emission levels, over time the filters can become clogged and less effective at reducing emission levels. To remove trapped matter, particulate filters may be periodically regenerated, whereby the filter temperature is raised to burn off particulate matter and remove it from the filter. However, filter regeneration can reduce the operational lifetime of the filter and can require additional energy to raise the filter temperature. Therefore, limiting filter regeneration cycles is desirable.

Filter performance may also be affected by the flow of exhaust gas entering the filter. For example, a non-uniform flow of exhaust gas can overload some regions of a filter by concentrating gas flow, and hence particulate matter, through certain regions of the filter system. Such uneven gas flow may accelerate clogging of the filter regions exposed to higher gas flows, leading to more frequent filter regenerations. Therefore, filter performance may be improved by providing a generally uniform flow of exhaust stream into the filter to evenly distribute the flow of particles through the filter, reduce uneven filter clogging, and decrease the frequency of filter regeneration.

One device configured to more evenly distribute exhaust gases is described in U.S. Pat. No. 6,745,562 (hereinafter "the '562 patent") of Berriman et al., issued on Jun. 8, 2004. The '562 patent describes a flow diverter configured for placement in an exhaust system. The diverter includes a structure with a central hole and conical walls configured to divert exhaust flow from a small diameter conduit to a larger diameter conduit immediately upstream of a catalytic converter.

While the device of the '562 patent may redistribute a flow of exhaust gas, the device can be further improved. In particular, the device of the '562 patent may not produce a sufficiently uniform flow of exhaust gas, and the device may create unnecessary backpressure within the exhaust system. Further, the device of the '562 patent may be costly to manufacture and may not be readily adaptable to operate with a range of differently sized exhaust systems.

The disclosed flow assembly is directed to overcoming one or more of the problems described above.

SUMMARY OF THE INVENTION

One aspect of the present disclosure is directed toward a flow assembly including a hollow housing having a lumen extending from a proximal aperture to a distal aperture. The flow assembly can include a first set of blades including at least one first blade disposed within the lumen, wherein the at least one first blade extends from the housing and can be positioned between the proximal aperture and the distal aperture. The flow assembly can also include a second set of blades including at least one second blade disposed within the lumen, wherein the at least one second blade extends from the housing and can be positioned between the at least one first blade and the distal aperture. Also, the flow assembly can include a central passageway substantially free of blades extending from the proximal aperture to the distal aperture.

Another aspect of the present disclosure is directed to an exhaust system including an exhaust device disposed within an exhaust flow. The exhaust system can include a flow assembly disposed within the exhaust flow and positioned upstream of the exhaust device. The flow assembly can include a hollow housing having a lumen extending from a proximal aperture to a distal aperture. The flow assembly can also include a first set of blades including at least one first blade disposed within the lumen, wherein the at least one first blade extends from the housing and can be positioned between the proximal aperture and the distal aperture. A second set of blades can be included within the flow assembly, such that at least one second blade can be disposed within the lumen, wherein the at least one second blade extends from the housing and can be positioned between the at least one first blade and the distal aperture. Also, the flow assembly can include a central passageway substantially free of blades extending from the proximal aperture to the distal aperture.

Another aspect of the present disclosure is directed to a method of manufacturing a flow assembly that can include forming a plurality of blanks, and forming a plurality of blade inserts from the plurality of blanks. The method can further include positioning the plurality of blade inserts within a housing, and fixedly attaching the plurality of blade inserts to the housing.

BRIEF DESCRIPTION OF THE DRAWINGS

The accompanying drawings, which are incorporated in and constitute a part of this specification, illustrate exemplary embodiments of the disclosure and, together with the written description, serve to explain the principles of the disclosed system. In the drawings.

DETAILED DESCRIPTION

Figure 1:
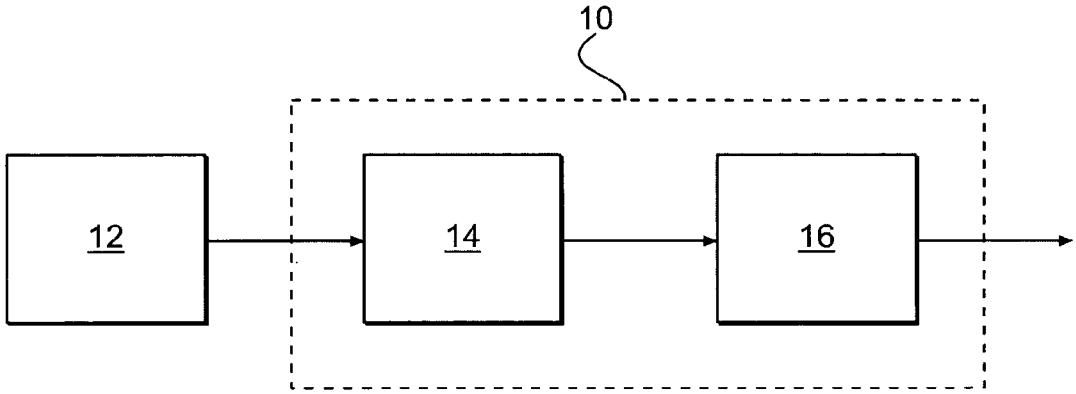
FIG. 1 is a schematic representation of an exhaust system, according to an exemplary disclosed embodiment.

FIG. 1 is a schematic representation of an exhaust system 10 according to an exemplary disclosed embodiment.

Exhaust system 10 may be configured to receive an exhaust stream from an exhaust-producing system and remove solid, liquid and/or gaseous compounds from the exhaust stream before exiting the exhaust stream to the atmosphere. The exhaust-producing system may include any system that produces air pollutants, such as, for example, a power source 12. Power source 12 may include any system configured to produce power. In some embodiments, power source 12 may include an internal combustion engine configured to combust any suitable fuel type, including diesel, gasoline, natural gas, biofuel, or mixtures thereof.

Exhaust system 10 may include a flow assembly 14 positioned upstream of an exhaust device 16. Flow assembly 14 may be positioned at any suitable location within exhaust system 10 and configured to receive a flow of exhaust gas. Specifically, flow assembly 14 may be configured to modify an exhaust stream such that gas flow downstream of flow assembly 14 may be more uniform than a gas flow upstream of flow assembly 14. For example, flow assembly 14 can be configured to redistribute a gas flow to provide a more uniform velocity and/or pressure profile of gas exiting flow assembly 14 than gas entering flow assembly 14. In addition, flow assembly 14 could be modular, wherein flow assembly 14 can be manufactured to form a single device, as described in detail below. Flow assembly 14 in modular form could be readily placed within and/or removed from exhaust system 10.

Exhaust system 10 may include one or more exhaust devices 16 designed to reduce the levels of emissions discharged into the surrounding environment. For example, exhaust device 16 may include catalytic converters, filters, or any suitable device configured to at least partially remove any unwanted material produced by power source 12. In some embodiments, exhaust device 16 may include a diesel particulate filter (DPF) or other type of filter configured to trap particulates, soot, or other materials found in exhaust gas.

Flow assembly 14 may be located upstream of exhaust device 16 such that exhaust gas entering exhaust device 16 may have a generally uniform flow profile. A generally uniform flow profile may include a gas flow that is generally uniform over a cross-section of the gas flow. For example, a turbulent flow may include a more uniform velocity and/or pressure profile over a cross-sectional area of gas flow than a velocity and/or pressure profile associated with laminar flow. A gas velocity at the center of turbulent gas flow may be similar to a gas velocity adjacent to the perimeter of the turbulent gas flow, while a gas velocity at the center of a laminar gas flow may be dissimilar to a gas velocity adjacent to the perimeter of the laminar gas flow.

A generally uniform gas flow exiting from flow assembly 14 can flow into exhaust device 16. Such an even distribution of gas flow entering exhaust device 16 can reduce the likelihood that one region of a cross-section of exhaust device 16 will receive significantly more gas flow than another region of the cross-section exhaust device 16. Overloading a region of exhaust device 16 by passing an increased gas flow through the filter material can lead to premature clogging of the overloaded region of filter material. In contrast, other filter regions of exhaust device 16 receiving less gas flow may remain under-utilized. A generally uniform gas flow entering exhaust device 16 can improve the efficiency of exhaust device 16 by more evenly distributing gas flow throughout exhaust device 16. For example, such a uniform gas profile may improve the efficiency of a filter by evenly loading the filter material, and/or reducing the frequency of filter regeneration procedures.

Figure 2A:
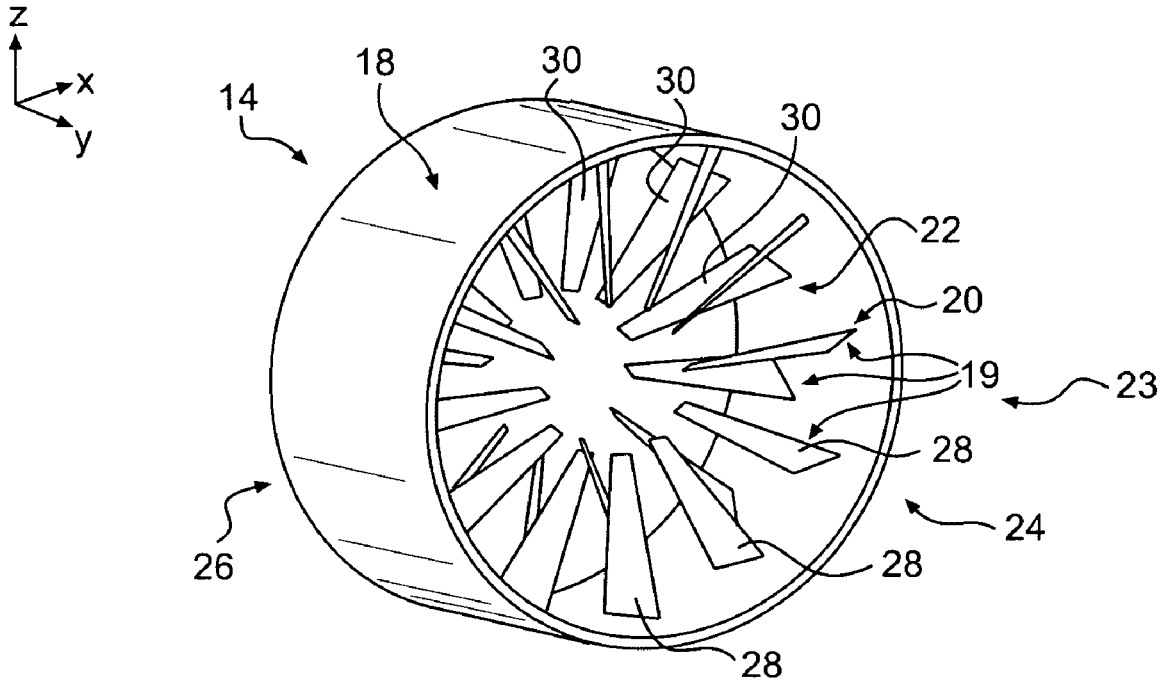
FIG. 2A is a three-dimensional illustration of a flow assembly, according to an exemplary disclosed embodiment.

FIG. 2A illustrates a schematic illustration of flow assembly 14, according to an exemplary disclosed embodiment. Flow assembly 14 may include a housing 18, and one or more blades 19. Housing 18 may include any suitable hollow structure configured to receive a flow of exhaust gas within exhaust system 10. For example, housing 18 may include a generally cylindrical structure, as shown in FIG. 2A, wherein a longitudinal axis of housing 18 is represented by the y axis. For example, housing 18 can include an outer dimension in a range of about 50 mm to 500 mm.

In some embodiments, housing 18 may be dimensioned and configured for placement upstream and/or adjacent to exhaust device 16. Housing 18 may include any suitable cross-sectional shape, such as, for example, a circular, oval, square, rectangular, triangular, or combinations thereof. Further, housing 18 may be tapered, whereby an outer and/or inner dimension may increase and/or decrease along a longitudinal axis (y axis) of housing 18.

Flow assembly 14 may include any number of blades 19. In particular, flow assembly 14 may include a first blade set 20 and a second blade set 22, wherein each blade set 20, 22 may include one or more blades 19. Each blade set can include one or more blades 19 positioned in a row within housing 18. Specifically, each blade of a blade set can be generally located on a common plane, such as, for example, a lateral plane within housing 18 represented by the x-z plane in FIG. 2A. In particular, blade sets 20, 22 may include one or more blades 19 in a lateral plane of flow assembly 14.

In some embodiments, blade sets 20, 22 can be located at two distinct lateral planes within a lumen 23 of flow assembly 14. Lumen 23 may fluidly connect a proximal aperture located at a proximal portion of housing 18 to a distal aperture 26 located at a distal portion of housing 18. Proximal aperture 24 can be configured to receive a gas flow within exhaust system 10. Distal aperture 26 can be configured to exit a gas flow upstream of exhaust device 16.

Figure 2B:
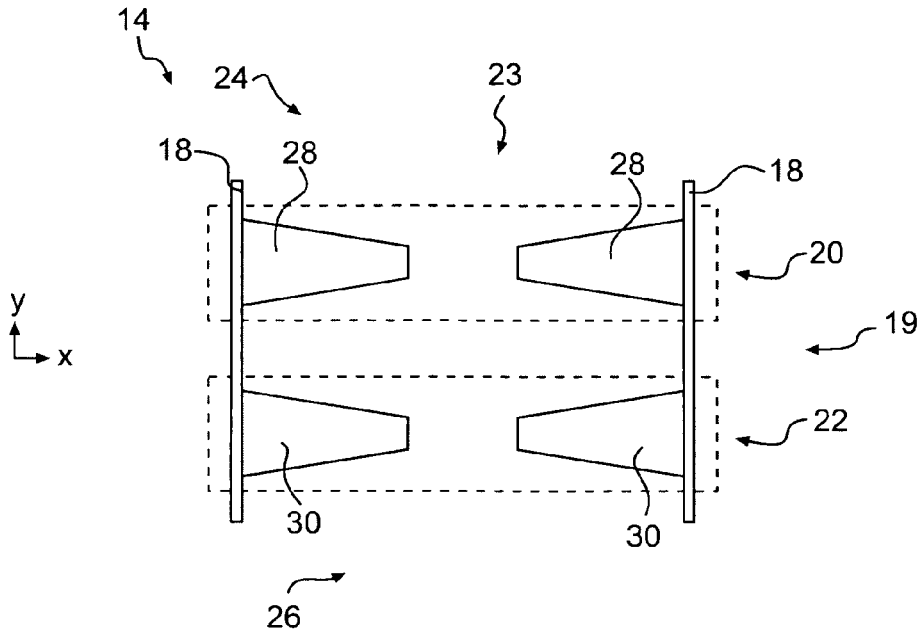
FIG. 2B is a longitudinal cross-section of a flow assembly, according to an exemplary disclosed embodiment.

As shown in FIG. 2B, first blade set 20 may be located adjacent to proximal aperture 24, and second blade set 22 may be located adjacent to distal aperture 26. Specifically, first and second blade sets 20, 22 may be positioned at any locations within lumen 23 such that first blade set 20 can be located proximate to second blade set 22 within lumen 23. It is also contemplated that flow assembly 14 may include more than two sets of blades.

First blade set 20 may include any number of blades 28 and second blade set 22 may include any number of blades 30, wherein blades 28, 30 may be configured to modify gas flow within flow assembly 14. Blades 28, 30 may be suitably distributed and configured within lumen 23 to create a generally uniform gas flow. For example, blades 28, 30 may be distributed radially in the x-z plane within lumen 23, as shown in FIG. 2C, and described in detail below.

In some embodiments, blades 28, 30 may extend radially from an inner surface of housing 18 toward a center of lumen 23. In other embodiments, blades may extend across lumen 23, from one location on the perimeter of lumen 23 to another location on the perimeter of lumen 23, and may be positioned parallel, perpendicular, or at any appropriate angle to other blades within housing 18. Blades 28, 30 may also be positioned at any suitable angle relative to a longitudinal axis (y axis) of housing 18. For example, first blade set 20 may include one or more blades 28 at a first angle while second blade set 22 may include one or more blades 30 at a second angle. Specifically, one or more blades 28 may be angled at +30 degrees to a longitudinal axis, when viewed from a base end of the blades towards the longitudinal axis of the housing 18, while one or more blades 30 may be angled at −30 degrees to the longitudinal axis. Also, one or more blades within a blade set can be positioned at angles different to angles of one or more other blades with the same blade set.

Blades 19 may be any suitable shape, including generally planar, tapered, or curvilinear, such as, for example, convex or concave configurations. Blades 19 may also include various features (not shown), such as, for example, extensions, indentations, coatings, or other surface features configured to enhance generation of turbulent flow and/or creation of a uniform gas flow. Also, first blade set 20 and/or second blade set 22 may include one or more different types of blades 19. For example, blades 28, 30 may include different shapes, distributions, and/or configurations within lumen 23.

Figure 2C:
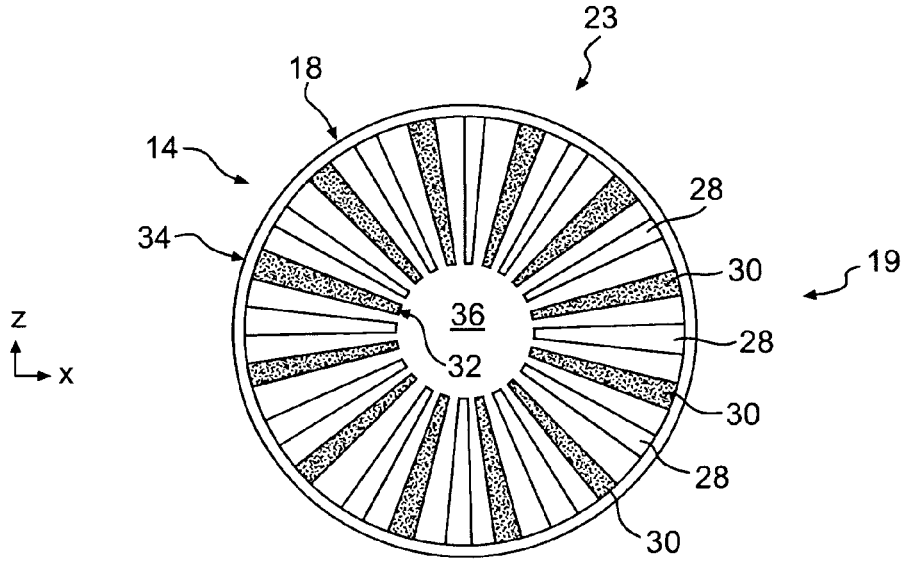
FIG. 2C is a lateral cross-section of a flow assembly, according to an exemplary disclosed embodiment.

FIG. 2C is a lateral cross-section of flow assembly 14, according to an exemplary disclosed embodiment. In some embodiments, blades 28, 30 may be distributed and configured as shown, wherein alternating blades 28, 30 form an approximately even radial distribution of blades 19. Such a configuration of unaligned blades, wherein blades 28 and blades 30 are not aligned along a common longitudinal direction, may impart sufficient turbulence on gas flowing through flow assembly 14 while limiting creation of unwanted backpressure. Similar flow modification may also result if blades from different blade sets are at least partially aligned along a common longitudinal direction, wherein blade 28 could be positioned over blade 30 when viewed in the x-z plane (not shown). In other embodiments, more than two sets of blades may be distributed and/or configured to form an approximately even radial distribution of blades in the x-z plane such that a generally uniform gas flow may exit flow assembly 14.

Blades 19 may include a tip 32 and a base 34, wherein base 34 is connected to housing 18 and tip 32 is located within lumen 23. In some embodiments, blades 28, 30 may be positioned and configured such that blade tips 32 do not extend to a center of lumen 23. Such a blade arrangement may permit generally unobstructed gas flow through a central passageway 36, wherein central passageway 36 may permit sufficient gas flow through a center of lumen 23 to create a generally uniform gas flow exiting flow assembly 14. Specifically, central passageway 36 may be substantially free of blades 19 and may extend from proximal aperture 24 to distal aperture 26. In addition, blades 19 may be shaped, distributed, and/or configured to provide a generally uniform gas flow in combination with central passageway 36.

Figure 3:
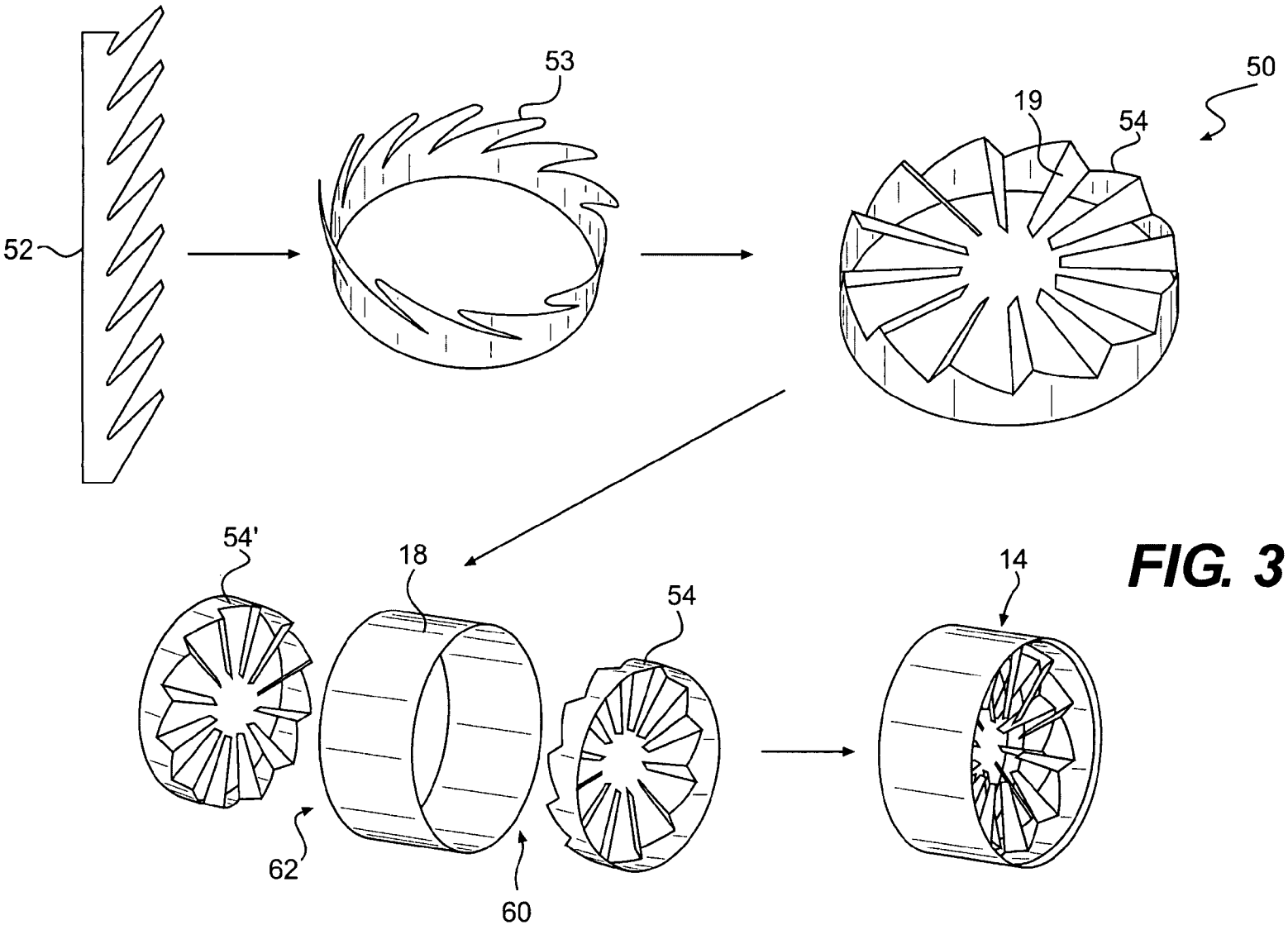
FIG. 3 is a schematic representation of a method of manufacturing a flow assembly, according to an exemplary disclosed embodiment.

FIG. 3 is a schematic representation of a method 50 of manufacturing flow assembly 14, according to an exemplary disclosed embodiment. Various components of flow assembly 14 can be manufactured from any material suitable for operation within exhaust system 10. Ideally, the material should be capable of withstanding high temperatures, high pressures, and generally resist corrosion. For example, suitable materials may include metal and metal alloys, such as, stainless steel.

Initially, a blade blank 52 can be produced from a sheet of suitable material (not shown). For example, blade blank 52 may be separated from the sheet of material by stamping, cutting, ablating, or similar process. Blade blank 52 may then be formed into a blade insert 54. In some embodiments, formation of blade insert 54 may include one or more intermediate processes, wherein one or more intermediate blanks 53 are produced. As shown in FIG. 3, intermediate blank 53 can be formed by forming blade blank 52 into a generally circular structure. Following, intermediate blank 53 can be processed to form one or more blades 19 of blade insert 54. In other embodiments, one or more blades 19 may be formed prior to forming intermediate blank 53. Blade insert 54 can be formed using any suitable process, such as, for example, molding, rolling, pressing, and/or folding.

Following formation of blade insert 54, two or more blade inserts 54 can be positioned within and fixedly attached to housing 18. Housing 18 may be formed from any suitable material as previously described, such as, for example, tubular steel. Housing 18 can be appropriately sized and shaped for placement within exhaust system 10, and configured to receive two or more blade inserts 54.

In some embodiments, two blade inserts 54, 54' may be positioned within housing 18. As shown in FIG. 3, blade insert 54 may be positioned within housing 18 at a proximal end 60 of housing 18, and blade insert 54' may be positioned within housing 18 at a distal end 62 of housing 18. Blade inserts 54, 54' may be positioned such that the various blades of blade inserts 54, 54' are positioned as shown in FIG. 2B, wherein the various blades of blade inserts 54, 54' are evenly distributed within housing 18.

Blade inserts 54, 54' can be fixedly attached to housing 18 following appropriate positioning of blade inserts 54, 54' within housing 18. Blade inserts 54, 54' may be fixedly attached using welding, brazing, clamping, friction fitting, threading, or other suitable fixation method. Various other steps and manufacturing processes can be used during the formation of flow assembly 14, such as, for example, coating, grinding, polishing, or heat treating.

INDUSTRIAL APPLICABILITY

Traditional exhaust systems may include various filters, catalytic converters, and other devices configured to remove particulate matter and other constituents from exhaust gas. Such exhaust systems can include ducts with bends, tortuous sections, or other configurations that may inadvertently create an uneven flow of exhaust gas. Uneven exhaust flow may cause clogging of some regions of a filter while under-utilizing other filter regions as different quantities of exhaust gas may pass through different regions of the filter material. Regions of material exposed to high gas flow may clog more quickly than other regions of material exposed to lower gas flow rates. Such uneven gas flow may reduce filter performance. For example, premature clogging may decrease the operational life of the filter and/or increase the need for filter regeneration. The present disclosure provides a flow assembly configured to create a more uniform gas flow upstream of an exhaust device, such as a particulate filter, thereby increasing filter performance. The present disclosure also provides an efficient method of manufacturing the flow assembly.

Flow assembly 14 may modify a non-uniform exhaust flow to create a more uniform exhaust flow by redirecting the exhaust flow passing through flow assembly 14. Flow assembly 14 may be positioned upstream of a filter or similar device that may benefit from an entering gas flow being generally uniform. In addition, flow assembly 14 should be capable of functioning in a range of exhaust system configurations and over a range of engine operating conditions. For example, flow assembly 14 should be configured to operate with exhaust gas temperatures of about 700° C. Also, flow assembly 14 should ideally only slightly increase any backpressure, require minimal or no maintenance, and be relatively inexpensive to manufacture.

As described previously, flow assembly 14 may include two or more sets of blades 20, 22, wherein each set of blades may include a plurality of blades 19. Blade shape, angle, and/or position may all be varied to increase the turbulence of the exhaust flow passing through flow assembly 14 to create a generally uniform flow profile. For example, blades 19 can be tapered whereby blade base 34 may be larger than blade tip 32, tilted at an angle relative to a longitudinal axis (y axis) of flow assembly 14, and/or positioned such that each blade is evenly radially distributed.

A generally uniform flow profile from flow assembly 14 should result without significantly increasing backpressure due to the presence of flow assembly 14 in exhaust system 10. Such performance can be obtained if flow assembly 14 includes two sets of twelve tapered blades positioned within two distinct lateral planes, wherein the blades are evenly distributed radially. One set of blades can be titled at +30° and the other set of blades can be titled at −30° with respect to a longitudinal axis of flow assembly 14. Such a blade arrangement may permit formation of a generally uniform gas flow without significantly raising backpressure. The blade arrangement may impart sufficient turbulence into the gas flow passing through flow assembly 14 to alter the flow profile of the exhaust gas. In addition, central passageway 36 can provide sufficient flow of exhaust gas through the center of lumen 23 to create a generally uniform gas flow without significantly increasing backpressure.

The present disclosure also provides an efficient method of manufacturing flow assembly 14. As shown and discussed above, flow assembly 14 can be manufactured in a simple and robust manner. In addition, only three components are required to produce flow assembly 14. These components require minimal machining and can be processed using standard manufacturing equipment. Therefore, the manufacturing method may permit low-cost manufacturing of flow assembly 14.

It will be apparent to those skilled in the art that various modifications and variations can be made to the disclosed flow assembly and manufacturing method. Other embodiments will be apparent to those skilled in the art from consideration of the specification and practice of the disclosed system. It is intended that the specification and examples be considered as exemplary only, with a true scope being indicated by the following claims and their equivalents.

What is claimed is:

1. A flow assembly for promoting turbulent flow, comprising:

a housing including a lumen extending from a proximal aperture to a distal aperture;

a first set of stationary blades including a plurality of first blades disposed within the lumen and positioned at a first positive angle relative to a longitudinal axis of the housing, wherein each of the plurality of first blades extends from the housing only partway across the lumen toward a center of the lumen, is connected by a common base at the housing, includes a free distal end at least partially defining a central passageway, and is positioned between the proximal aperture and the distal aperture; and a second set of stationary blades including a plurality of second blades disposed within the lumen and positioned at a second negative angle relative to the longitudinal axis of the housing, wherein each of the plurality of second blades extends from the housing only partway across the lumen toward a center of the lumen, is connected by a common base at the housing, includes a free distal end at least partially defining the central passageway of the housing, and is positioned between the first set of stationary blades and the distal aperture, wherein the central passageway is substantially free of blades and extends from the proximal aperture to the distal aperture.

2. The flow assembly of claim 1, wherein the first set of stationary blades and the second set of stationary blades are radially distributed within the lumen around the central passageway.

3. The flow assembly of claim 1, wherein the first set of stationary blades includes twelve blades and the second set of stationary blades includes twelve blades.

4. The flow assembly of claim 1, wherein at least one of the plurality of first blades and at least one of the plurality of second blades are planar and have a width at the common base greater than a width at the central passageway.

5. The flow assembly of claim 1, wherein a cross-sectional shape of the housing is a circle.

6. The flow assembly of claim 1, wherein the housing has an outer dimension in a range of about 50 mm to 500 mm.

7. The flow assembly of claim 1, wherein the first set of stationary blades is substantially identical to the second set of stationary blades in number and shape.

8. The flow assembly of claim 1, wherein the first set of stationary blades is oriented in opposition to the second set of stationary blades relative to the exhaust flow.

9. The flow assembly of claim 1, wherein blades of the first set of stationary blades are located between blades of the second set of stationary blades.

10. An exhaust system, comprising:

an exhaust device disposed within an exhaust flow and configured to reduce a constituent of the exhaust flow;

a turbulent flow generating assembly disposed within the exhaust flow upstream of the exhaust device and configured to substantially uniformly distribute the exhaust flow across a face of the exhaust device, wherein the turbulent flow generating assembly includes:

a housing including a lumen extending from a proximal aperture to a distal aperture;

a first set of stationary blades disposed within the lumen, extending from the housing, and positioned between the proximal aperture and the distal aperture at a first common axial location;

a second set of stationary blades disposed within the lumen, extending from the housing and positioned between the first set of stationary blades and the distal aperture at a second common axial location; and a central passageway substantially free of blades extending between the proximal aperture and the distal aperture, wherein the exhaust device includes at least one of a diesel particulate filter and a catalytic converter.

11. The exhaust system of claim 10, wherein the first set of stationary blades and the second set of stationary blades are radially distributed within the lumen, each blade of the first set of stationary blades located between adjacent blades of the second set of stationary blades when viewed along a longitudinal axis of the lumen.

12. The exhaust system of claim 10, wherein the first set of stationary blades includes twelve blades and the second set of stationary blades includes twelve blades.

13. The exhaust system of claim 10, wherein each blade of the first set of stationary blades is at a first positive angle with respect to a longitudinal axis of the housing and each blade of the second set of stationary blades is at a second negative angle with respect to a longitudinal axis of the housing.

14. The exhaust system of claim 10, wherein each blade of the first and second sets of stationary blades is tapered and planar.

15. The exhaust system of claim 10, wherein a cross-sectional shape of the housing is a circle.

16. The exhaust system of claim 10, wherein the housing has an outer dimension in a range of about 50 mm to 500 mm.

17. An exhaust system comprising:

a passageway configured to receive a flow of exhaust from an engine;

an exhaust device located within the passageway to remove unwanted material from the flow of exhaust;

a first blade set insert positioned within the passageway upstream of the exhaust device; and a second blade set insert substantially identical to the first blade set insert positioned within the passageway upstream of the exhaust device, downstream of the first blade set insert, and in an opposite flow orientation relative to the first blade set insert, wherein:

blades of the second blade set insert are positioned between blades of the first blade set insert when viewed along a longitudinal axis of the passageway; and blades of the second blade set insert are oriented at an angle opposite an angle of blades of the first blade set insert relative to a longitudinal axis of the passageway.

18. The exhaust system of claim 17, wherein the exhaust device is a particulate filter, and the first and second blade set inserts are configured to generate turbulence in the exhaust flow and substantially uniformly distribute the exhaust flow across a face of the particulate filter.

* * * * *